US005263262A

United States Patent [19]

Steere, Jr.

[11] Patent Number: 5,263,262

[45] Date of Patent: Nov. 23, 1993

[54] YARDAGE MARKERS FOR GOLF COURSES AND METHOD OF MAKING SAME

[76] Inventor: Frank W. Steere, Jr., 810 Merriman Rd., Akron, Ohio 44303

[21] Appl. No.: 929,978

[22] Filed: Aug. 14, 1992

[51] Int. Cl.[5] ..... A63B 67/02; A63B 57/00; A63C 19/06

[52] U.S. Cl. ..... 33/700; 273/32 H; 273/32 R; 52/103; 40/217; 40/596

[58] Field of Search ..... 33/700, 701, 506, 289; 273/32 R, 32 A, 32 B, 32 H, 176 B, 181 R, 176 A; 116/209, 211; 52/103, 105; 40/124.1, 217, 596, 615, 616; 15/215

[56] References Cited

U.S. PATENT DOCUMENTS

| | | | |
|---|---|---|---|
| 529,858 | 11/1894 | Hardwick | 15/215 |
| 3,395,625 | 8/1968 | Blanchette et al. | 273/32 R |
| 4,489,669 | 12/1984 | Carman | 273/32 R |
| 5,029,855 | 7/1991 | Jamieson et al. | 273/32 B |
| 5,114,149 | 5/1992 | Bailey | 273/32 H |

FOREIGN PATENT DOCUMENTS

| | | | |
|---|---|---|---|
| 2202155 | 9/1988 | United Kingdom | 273/32 H |

*Primary Examiner*—William A. Cuchlinski, Jr.
*Assistant Examiner*—C. W. Fulton
*Attorney, Agent, or Firm*—Renner, Kenner, Greive, Bobak, Taylor & Weber

[57] ABSTRACT

Markers particularly adapted for golf courses have a base with numerical indicia formed thereon. The indicia are preferably raised above the base and have a color that contrasts with the color of the base. In one embodiment the base and the numerical indicia both have upstanding fibril members which resemble the grass surface surrounding the yardage marker. The markers are formed in a mold wherein a fusible material, which may be a vinyl plastisol, having the color desired for the numerical indicia is introduced into the indicia-forming cavities in the mold and gelled. The fusible material having the color desired for the base is then poured into the base-forming cavity. An anchoring fitting is inserted into the base-forming cavity so that a portion thereof will be encapsulated in the material forming the base. After all the components of the marker are received within the mold, it is heated to fuse the fusible material within the mold into an integral whole. The fusible material is introduced into the indicia-forming cavities in such a way that it will not flow into the base-forming cavity. The mold is preferably de-aerated in order to preclude the entrapment of air between the mold and the fusible material introduced into the mold. The yardage markers may be secured in the desired location on the golf course by threadably attaching the anchoring fitting to an anchor rod which may be driven into the ground at a predetermined location.

5 Claims, 8 Drawing Sheets

YARDAGE MARKERS FOR GOLF COURSES AND METHOD OF MAKING SAME

TECHNICAL FIELD

The present invention relates generally to markers. More particularly, the present invention relates to markers having a numeric indicia embossed thereon. Specifically, the present invention relates to markers that are particularly adapted for use on golf courses.

BACKGROUND OF THE INVENTION

Golf courses, as a matter of common practice, install at least one yardage marker on each fairway to inform the golfer of a standard distance from the marker to the green. Such yardage markers are normally located in the center of the fairway, and in some situations in the rough, at the side of the fairway, but in either situation, at a predetermined distance measured to the center, or, on occasion, to the front, of the green. Golfers typically rely on those markers for club selection. Inasmuch as most golfers know the maximum distance that can be obtained by them with a given club such as a five iron, or a three wood, knowing the distance to the green can facilitate selection of the appropriate club. As beneficial as yardage markers can be in selecting the proper club, that benefit can only be enjoyed if the marker can be located by the golfer. Unfortunately, a considerable amount of time can be spent locating the presently employed markers. The time spent in searching for a marker prolongs the time required to play a round of golf, which not only reduces the number of golfers that can play the course during a given period of time but also tends to raise the ire of those golfers waiting for the player to select a club. This includes the golfers with whom the person is playing, and certainly those golfers in the next successive group playing that particular hole.

Markers heretofore employed have included wooden stakes erected in the rough along the side of the fairway as well as concrete slabs embedded in the fairway or special covers mounted on sprinkler heads. Stakes and concrete slabs can be accurately placed at the desired distance. The sprinkler covers, however, must be installed at locations mandated by the desired watering pattern. In any event, markers mounted on sprinkler heads can be quite difficult to locate, especially when playing a strange course.

When stakes are used, they are normally placed in the rough along the lateral edge of the fairway. These stakes can, on occasion also interfere with the "lie" of the ball, resulting in the necessity to move the ball and perhaps cause some argument as to the exact location from which the ball should be played. It is also difficult to mow around fixed stakes, without special attention. For both reasons some golf courses have installed removable stakes to obviate the problems inherent with fixed stakes, but some golfers are careless and can forget to return the stakes to their mount after the ball has been played. In addition, removable stakes can be pilfered. As a result, golf course managements tend to use a minimum number of stake markers for each hole.

When markers are used in the fairway they are placed flush with, or slightly below, the surface of the fairway. Specifically, a flush, white marker would be placed at a distance of 150 yards from the green. Some golf courses also employ a blue marker placed at a distance of 200 yards from the green, and a red marker placed at a distance of 100 yards from the green.

When concrete markers are placed in the fairway, they can be difficult to locate inasmuch as they must be mounted low enough so that mowers can go over them without causing damage to the mower. In addition, concrete markers must be anchored deep enough to minimize, if not to prevent, heaving as a result of frost or freezing. It must also be appreciated that the concrete markers can cause an unnatural bounce to any ball which strikes them. Hence, concrete markers may be placed at exact locations on the fairway to mark preselected distances to the green, but they may not be readily visible, and they can cause unexpected bounces when struck by the ball.

SUMMARY OF THE INVENTION

It is, therefore, a primary object of the present invention to provide improved markers particularly adapted for use on golf courses, and a method of manufacturing such markers.

It is another object of the present invention to provide improved markers, as above, and a method of manufacturing such markers wherein the markers have a base of one color and a numeric indicia of another color.

It is a further object of the present invention to provide improved markers, and a method of manufacturing such markers, as above, wherein the numeric indicia may be raised above the base of each marker.

It is still another object of the present invention to provide improved markers, and a method of manufacturing such markers, as above, wherein upstanding, grass-like bristles are formed to extend not only from the indicia but also from the base, in corresponding colors with that portion of the marker from which the bristles extend—the bristles providing a continuous playing surface across each marker.

It is yet another object of the present invention to provide an improved method of manufacturing markers, as above, wherein a fusible, plastic compound of one color is poured into selected cavities in a mold to form indicia and that pour is permitted to gel prior to filling the mold with a successive pour of substantially the same compound in another color, an anchoring member being secured within the base, and the mold being thereafter heated to fuse the two pours into a unitary whole.

It is also an object of the present invention to provide an improved method of making markers, as above, wherein a mold is provided with a plurality of trichoid sub-cavities intended to form grass-like fibrils, or bristles, that will extend not only from the yardage indicia but also from the base of each marker so that the indicia-forming cavities and the trichoid sub-cavities extending from the indicia-forming cavities may be substantially filled with a fusible material that is permitted to gel sufficiently to prevent mixing with another color of the same, or a compatible, fusible material which is poured into the mold after the fusible material poured into the indicia-forming cavities has gelled.

These and other objects of the invention, as well as the advantages thereof over existing and prior art forms, which will be apparent in view of the following detailed specification, are accomplished by means hereinafter described and claimed.

In general, the present invention provides unique yardage markers for use in designating distances on golf courses. The unique markers overcome the drawbacks of the prior art. In addition, the unique markers may be expeditiously manufactured and installed, thereby facilitating multiple usages thereof on the fairway of each hole in order to provide information which enables golfers to make more rapid club selections. This is particularly advantageous to golf club managements in that it enables a greater number of players to use the course each day.

A novel method of making the yardage markers is also disclosed herein. Markers manufactured in accordance with the present invention permit a base member to be of one color and the yardage indicia of another, preferably contrasting color. For example, a yardage marker may have a white base and black indicia.

Yardage markers embodying the concepts of the present invention may be readily made from vinyl plastisol in suitable molds. Indicia cavities may be formed in the mold in a manner such that the resulting indicia will preferably extend at least slightly above the base when placed on the fairway. Plastisol of the selected color for the indicia is poured into the mold substantially to fill the indicia cavities and is allowed to gel, the base color plastisol and a threaded anchoring member are then introduced into the mold cavity. The combination is then heated to fuse the gelled layers in the desired array.

In the exemplary forms of the yardage marker depicted, the anchoring member permits the yardage marker to be installed on a threaded anchor rod that is located, where desired, on or along the fairway. The vinyl plastisol material will minimize unusual bounces or deflections when struck by the ball.

An alternative embodiment is provided wherein hair-like, or grass-like, bristles, or fibrils, are provided by forming appropriate trichoid sub-cavities in the mold. In order to fabricate this embodiment, it is suggested that a pre-measured charge of the plastic be introduced into the indicia-forming cavities and their associated sub-cavities, and preferably in an environment wherein those cavities and sub-cavities are de-aerated after introduction and before gelling or fusing. After the plastic within the indicia-forming cavities and the sub-cavities associated therewith have gelled, the appropriately colored plastic is introduced into the base-forming cavity and the sub-cavities associated therewith—also de-aerated, as previously described. With an anchoring member positioned within the plastic in the base-forming cavity the mold is heated to fuse the separately introduced plastic material into a unitary whole. This will permit both the indicia and base of each marker to have upstanding, grass-like bristles, the color of which is consistent with that of the underlying portions of the marker. Moreover, this embodiment of the invention will minimize interference with the play of the ball inasmuch as the ball will respond to the yardage marker in much the same manner as it reacts to the normal grass playing surface.

Because of the contrasting, and highly visible, though unobtrusive, colors that can be employed in markers according to the present invention, such yardage markers may be easily located by the golfer. The longevity of such markers makes is economically feasible for golf course to install more markers than would othewise be used. For example, the markers may be placed at perphaps fifty yard intervals in the center of the fairway, with additional markers placed along the lateral side portions of the fairway at distances that are half-way between those located in the center of the fairway. With this layout, the golfers can quickly and accurately determine the distance to the green such that club selection is greatly enhanced.

Three exemplary embodiments of yardage markers embodying the concepts of the present invention, and adapted for use on golf courses, are deemed sufficient to effect a full disclosure of the subject invention, are shown by way of examples in the accompanying drawings and are described in detail without attempting to show all of the various forms and modifications in which the invention might be embodied; the invention being measured by the appended claims and not be the details of the specification.

DESCRIPTION OF THREE PREFERRED EMBODIMENTS

Figure 1:
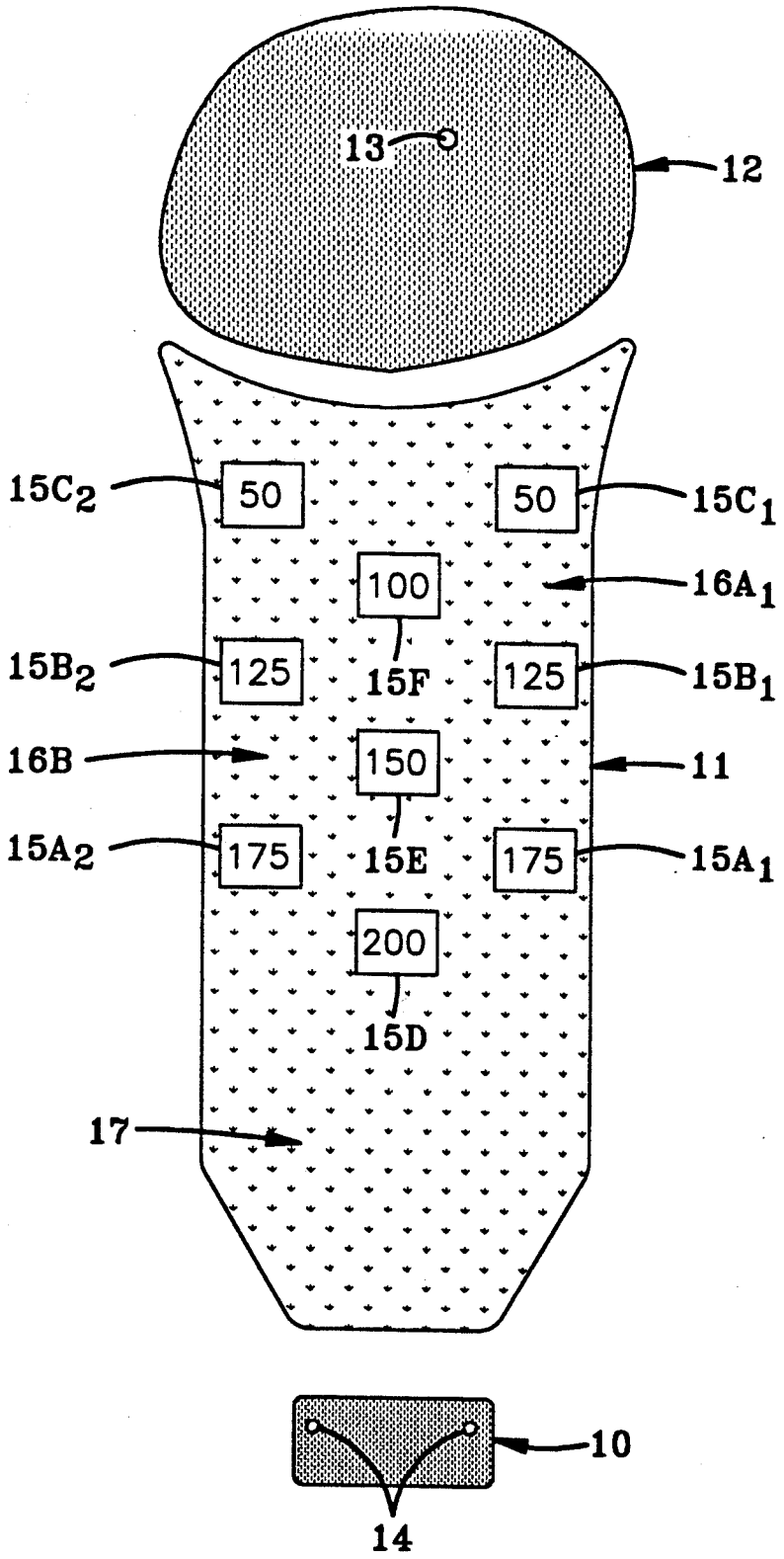
FIG. 1 is a diagrammatic representation of a typical "hole" on a golf course utilizing markers that embody the present invention.

Referring to the drawings, wherein like numerical designations represent the same or corresponding parts throughout the several views of each embodiment, FIG. 1 constitutes a diagrammatic representation of a portion of a golf course which incorporates a plurality of the hereinafter described markers that embody the concepts of the present invention. The "hole" of a golf course depicted in FIG. 1 is represented by a teeing area 10, a fairway 11 and a green 12. The teeing area 10, as is well known, normally has three pair (only one pair is shown) of laterally spaced, spherical markers 14 which define the forward as well as the lateral edges of the area in which a player of designated gender, or of professional standing, is to tee-up the golf ball prior to driving, or hitting, the ball onto the fairway 11. After driving the ball onto the fairway 11, and locating the driven ball, the golfer must select a club with which to strike the ball in an effort to get closer to, or reach, the green 12. Reaching the proper green 12 and putting the ball into the hole 13 in the least number of "strokes'-'—i.e., with the least number of club hits—is the object of the game. Thus, it is important, after driving the ball from the tee 10 onto the fairway 11, that the player be able to determine, or closely judge, the distance remaining to the green 12. This determination will assist the golfer in the selection of that specific club with which the next stroke will be most likely to result in either driving the ball onto the green 12 or for the ball to reach another point on the fairway from which the green 12 can be reached with the minimum number of strokes.

As depicted in FIG. 1, the fairway 11 has been provided with a plurality of yardage markers, or indicia plaques, 15 positioned along the lateral side portions $16A_1$, and 16B of the fairway as well as along the central portion 17 of the fairway 11. For example, the yardage markers $15A_1$ and $15A_2$, set along the lateral side portions $16A_1$, and 16B of the fairway each designate a distance of 175 yards to the green 12. Two other pairs of yardage markers 15 are also represented as being set along the lateral side portions 16 of the fairway. Specifically, yardage markers $15B_1$ and $15B_2$ each designate a distance of 125 yards to the green, and yardage markers $15C_1$ and $15C_2$ each designate a distance of 50 yards to the green. The distances designated by the markers 15A, 15B and 15C, all located along the lateral side portions 16 of the fairway 11 are measured from the green along the longitudinal center of the fairway 11 to an imaginary line drawn between the markers $15A_1$ and $15A_2$, $15B_1$ and $15C_1$ and $15C_2$, respectively.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are a plurality of yardage markers which are generally identified by the numeral 15, but the specific, individual yardage markers are, therefore, identified as 15A, 15B, etc. in the specification and on the drawings. Where there are two or more markers having additional similarities, those markers will be designated by numeric subscripts in addition to the suffix designation—e.g.: $15A_1$ and $15A_2$, each of which present the same numerical yardage designation. This same convention shall be employed throughout the specification.

In addition to the yardage markers located along the lateral side portions 16 of the fairway 11, other markers 15 may be located at predetermined distances from the green along the central portion 17 of the fairway 11. For example, the yardage marker 15D designates 200 yards remaining to the green 13; yardage marker 15E designates 150 yards remaining to the green 12; and, yardage marker 15F designates 100 yards remaining to the green 12. The markers 15D through 15F may be placed at locations along an imaginary line along which the distances are measured.

Because the yardage markers 15 are judiciously placed at useful distances along the fairway 11—both along the lateral side portions 16 thereof as well as along the center portion 17 thereof—the golfer can, and will, rely on these yardage markers 15 to determine which club should be used. This is particularly true with seasoned golfers who are cognizant of the distance to which they will be normally capable of driving with each club. The yardage markers should, therefore, be sufficiently prominent, though unobtrusive to the natural beauty of the course, so that the golfer can readily locate the nearest marker 15 and quickly ascertain the remaining distance to the green 12.

Figure 2:
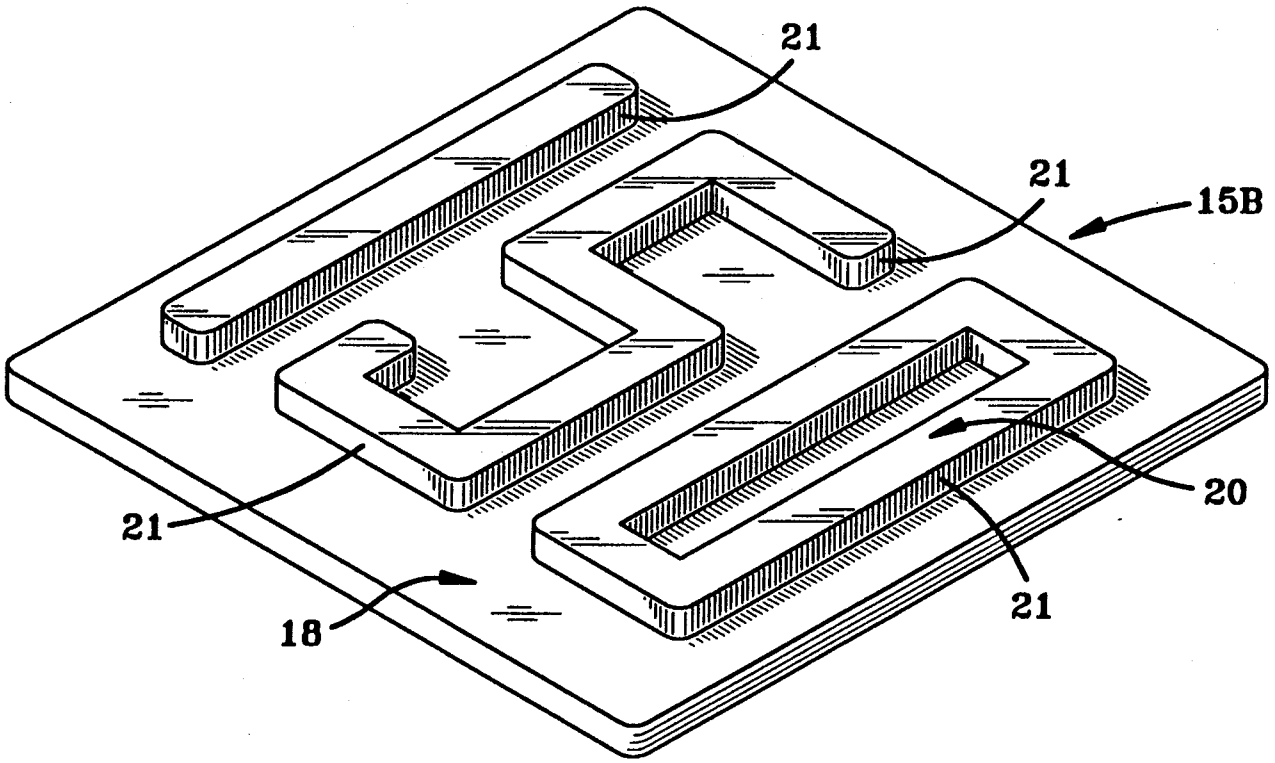
FIG. 2 is a perspective view of the first embodiment of a marker embodying the present invention.
Figure 3:
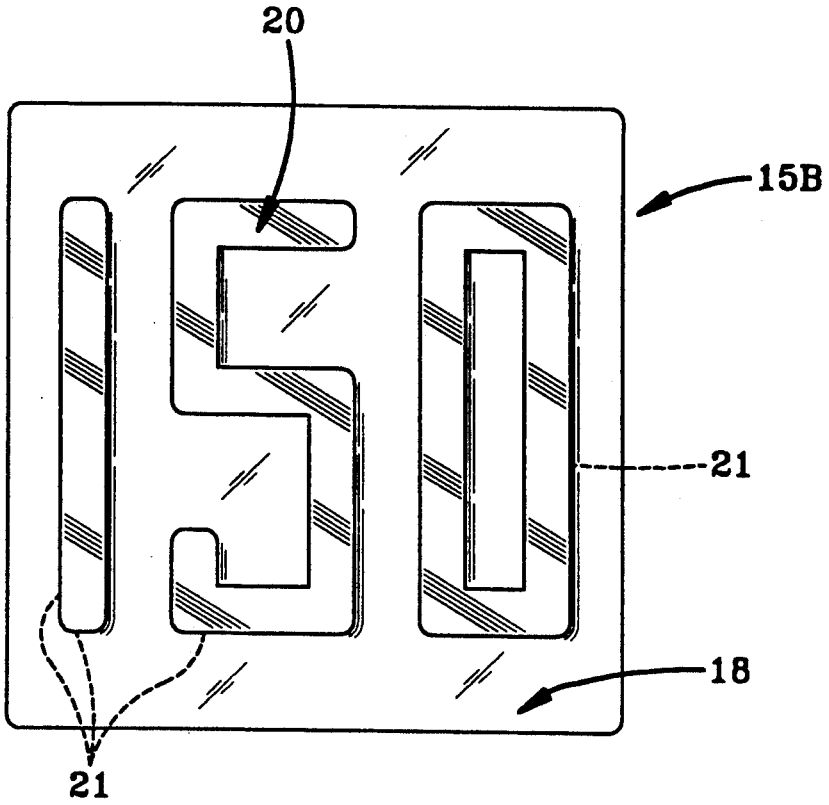
FIG. 3 is a top view of the embodiment shown in FIG. 2.
Figure 4:
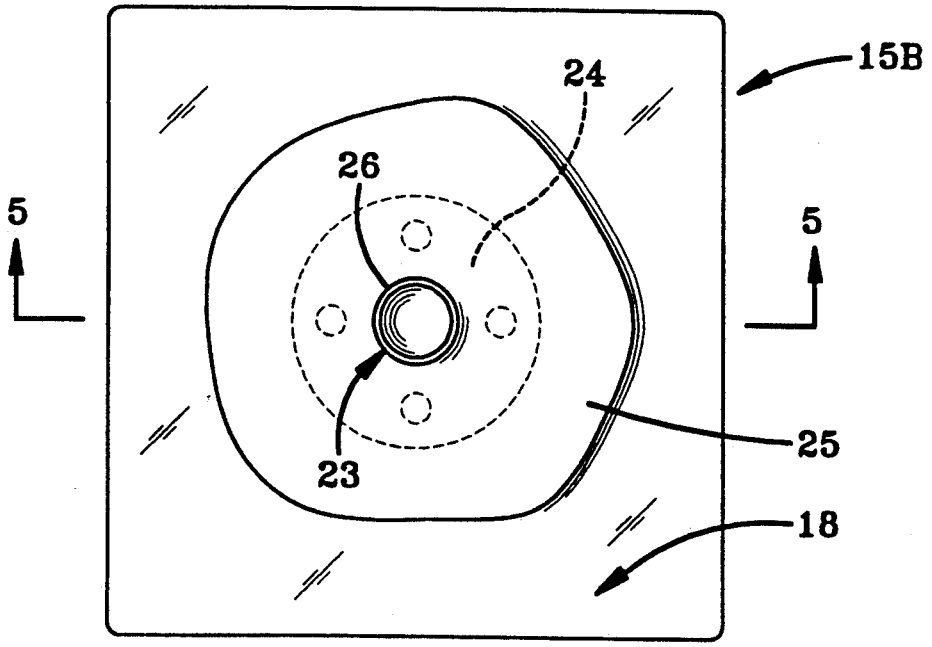
FIG. 4 is a bottom view of the embodiment shown in FIG. 2.

One representative yardage marker 15E is depicted in FIG. 2. FIGS. 3 and 4 are the top and bottom views, respectively, of the yardage marker 15E represented in FIG. 2. This yardage marker 15E has a base portion 18 and a preferably raised numerical indicia 20. The indicia 20 on marker 15E comprises the number "150" (i.e.: to signify one-hundred and fifty yards), each digit of which has the necessary number of side walls 21 that extend outwardly from the base 18. These numerical indicia 20 are preferably of one attribute—i.e., color—while the base 18 is of another, preferably contrasting, color attribute. For example, the base 18 can be white and the indicia 20 can be black. The white color is already the standard color code for 150-yard markers on the majority of golf courses in The United States.

Figure 5:
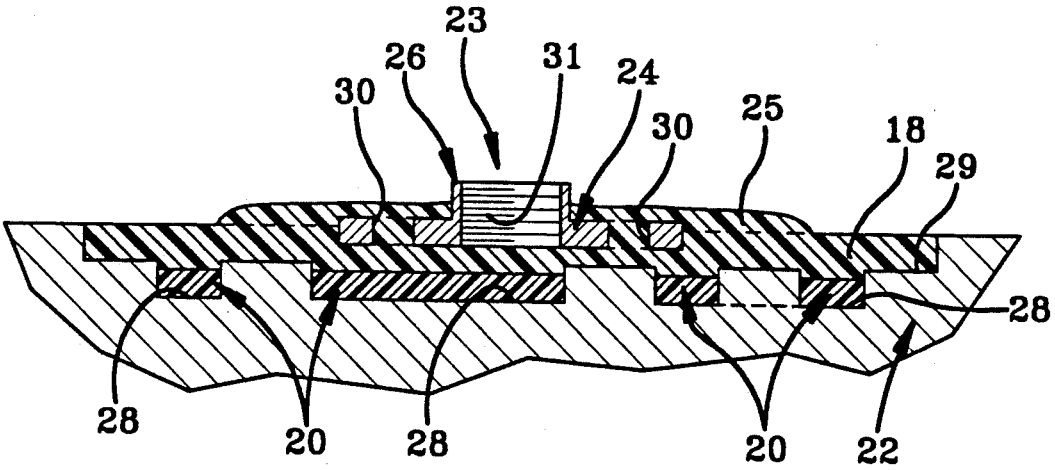
FIG. 5 is a view taken along line 5—5 in FIG. 4, but with the marker still in the mold.

The base 18 and the numerical indicia 20 are preferable constructed of a fusible plastic such as vinyl plastisol which will permit the yardage markers 15 to be formed in a mold such as that identified by the numeral 22 in FIGS. 4 and 5.

As best seen in FIG. 4, an anchoring means in the nature of a typical pipe fitting 23 is secured within the underside of the base 18. The anchoring fitting 23 may, as shown, include a flange portion 24 that is encapsulated within the base 18. To ensure encapsulation of the flange portion 24, a freeform overlay 25 of the fusible plastic may be applied to the underside of the base 18 so as to cover the flange 24. A connector portion 26 is secured to the flange 24 and may extend outwardly from the base 18 in a direction opposite the indicia 20.

With reference to FIG. 5 one can observe how the yardage marker 15E can be cast in the mold 22. Specifically, mold 22 has lower cavities 28 for forming the indicia 20 and an upper cavity 29 for forming the base 18. Thus, as seen in FIG. 5, the indicia 20 are shaped in the indicia-forming cavities 28 disposed below the level of the base-forming cavity 29. To cast the present yardage marker, the fusible plastic—such as a vinyl plastisol—which will form the indicia 20 will be introduced into the indicia-forming cavities 28 of the mold 22. The plastic material introduced should at least partially fill the cavities 28 but not be permitted to flow into the base-forming cavity 29.

The vinyl plastisol in the cavities 28 will be permitted to gel, or partially harden, for a period of time that will depend upon the particular polymers employed. Typically, one may well choose a polymer that will gel in a range of from about two to about six minutes at temperatures ranging from about 150 to about 275 degrees (F). When the indicia 20 have thus gelled to the point that there is a sufficient modicum of integrity to the indicia already formed, the fusible plastic—which may also be a vinyl plastisol—that will form the base 18 is poured into the uppermost, or base-forming, cavity 29. This second pour will cover the lower cavities 28 and therefore the indicia 20 formed therein. After, or just prior to the time that, the cavity 29 is completely filled, the anchoring fitting 23 may be positioned in the base-forming cavity 29. If necessary, additional plastisol in the nature of the overlay 25 may be poured over the flange portion 24 of the anchoring fitting 23 in order to be certain that the flange 24 on the anchoring fitting 23 will be as completely encapsulated within the base 18 of the marker 15, as is desired to secure the anchoring fitting 23 to the base 18. Thereafter the mold 22 is placed in an oven, or is otherwise heated, to a temperature which will cause the two pours of plastisol within the mold 22 to fuse. This fusion causes the base 18 and numerical indicia 20 to form an integral whole and also to ensure that the anchoring fitting 23 is firmly secured within the base 18. To continue the previous example of a plastisol such a material will fuse at a temperature falling within the range of from about 340 degrees to about 360 degrees (F.) for a period of time falling in the range of from about 30 minutes to about 45 minutes.

Figure 6:
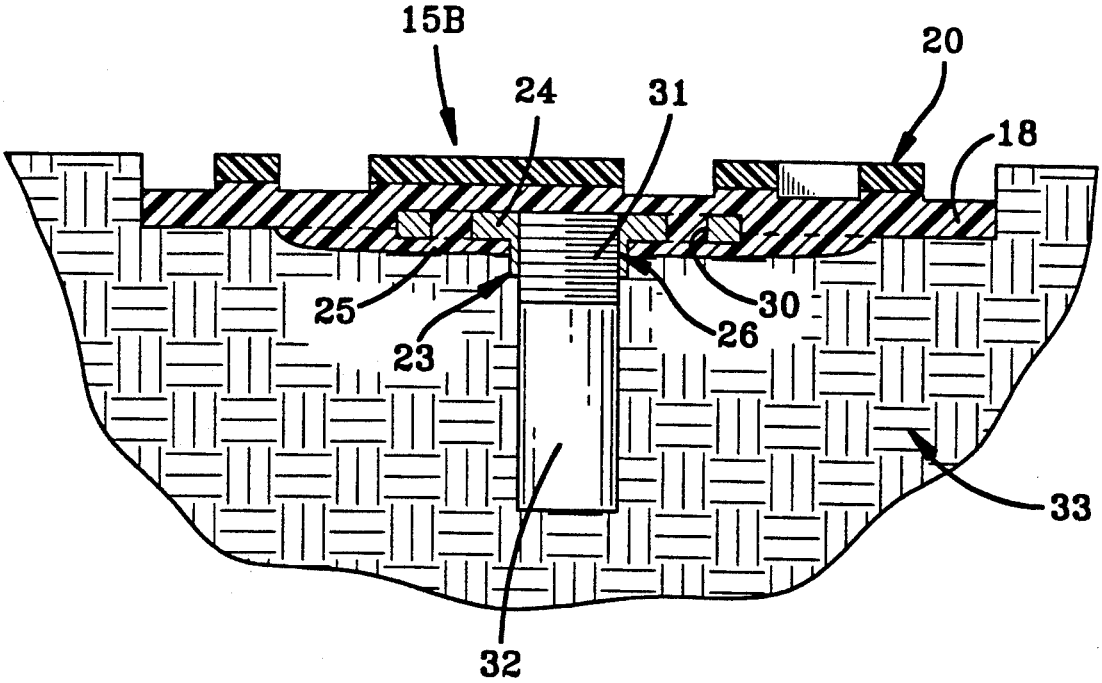
FIG. 6 is a view similar to FIG. 5 depicting the marker properly inverted and installed in the fairway of a golf course.

The anchoring fitting 23 can be of any shape desired. However, one shape that has been found to be successful employs a substantially planar flange portion 24 that is penetrated by a plurality of apertures 30. The apertures 30 permit the plastisol to pass through the flange 24 at selected locations in order to improve the mechanical bond between the plastisol forming the base 18 of the marker 15 and the anchoring fitting 23. The central hub, or connector portion, 26 of the fitting 23 is integral with the flange 24. The connector portion 26 is preferably hollow, the cylindrical interior of which is provided with threads 31. The threads 31, as best seen in FIG. 6, may be used to secure the marker 15 to an anchor rod 32 which may be inserted into the ground 33. The anchor rod 32 has an externally threaded portion 34 which will mate with the threads 31 on the interior of the connector portion 26 such that the yardage marker 15 can be threaded onto the anchor rod 32 and be thereby secured to the ground 33.

The anchor rod 32 is preferably inserted into the ground 33 (FIG. 6) prior to the time that the yardage marker 15 is threaded onto the anchor rod 32. This will facilitate accurately setting the anchor rods 32. However, should it be necessary, for some reason, temporarily to remove the yardage marker 15, that result can be readily accomplished by unthreading the marker 15 from the anchor rod 32. Other latching or securing means, such as bayonet fittings, can be used. It is even possible to install a locking mechanism, if desired. Also, it is possible to mold other indicia into the base 18 such as the number of the hole, the name of the golf course, the designer of the golf course, and/or the distance from the tee, to name a few.

Figure 7:
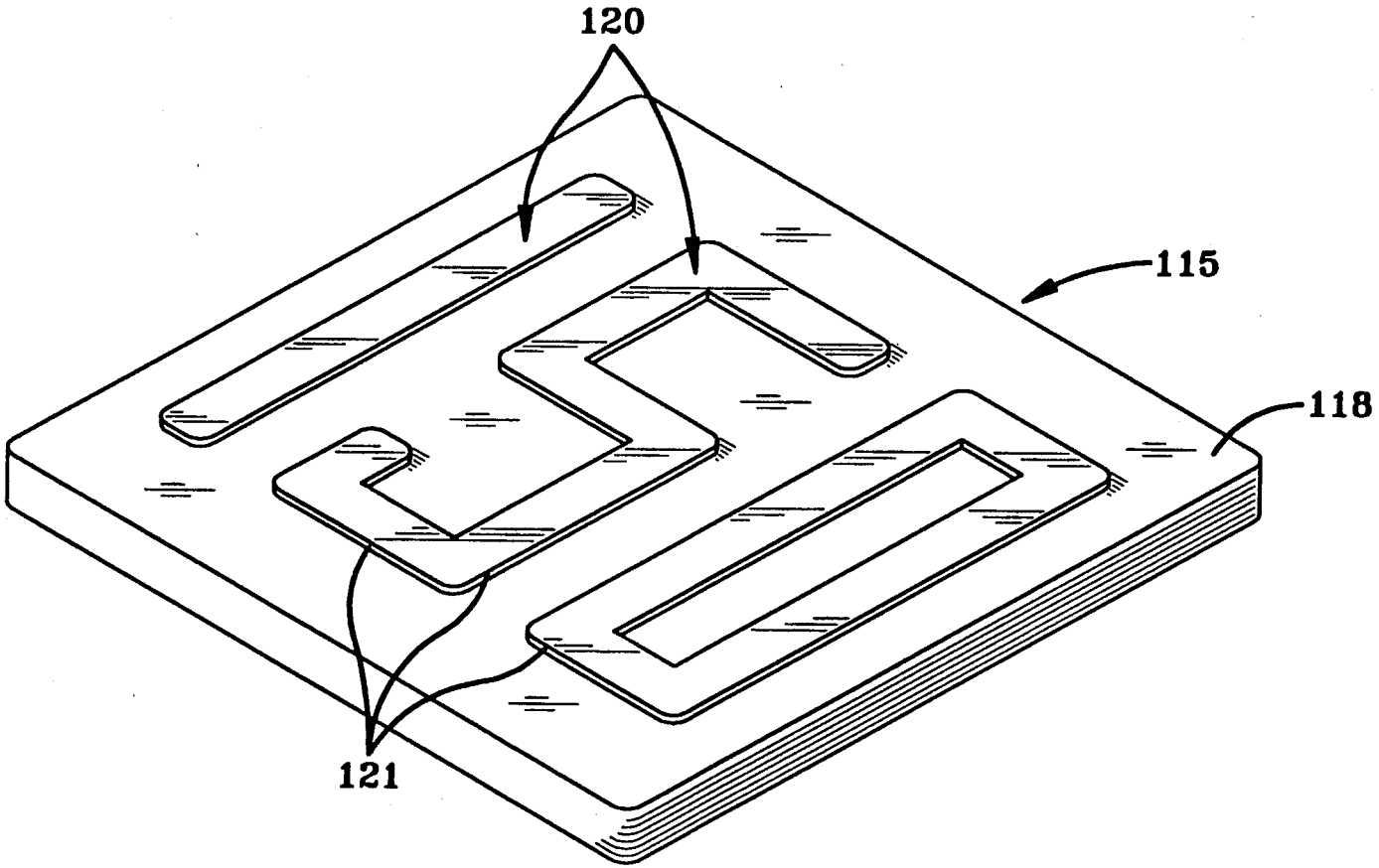
FIG. 7 is a perspective view of a second embodiment of a marker that also incorporates the present invention.
Figure 8:
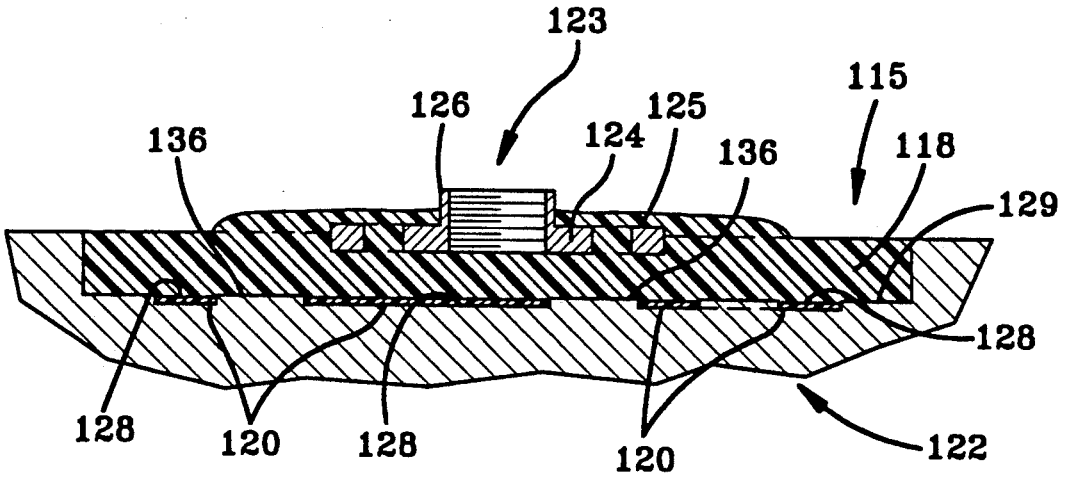
FIG. 8 is a view similar to FIG. 5 depicting the marker of FIG. 7 in a mold.
Figure 9:
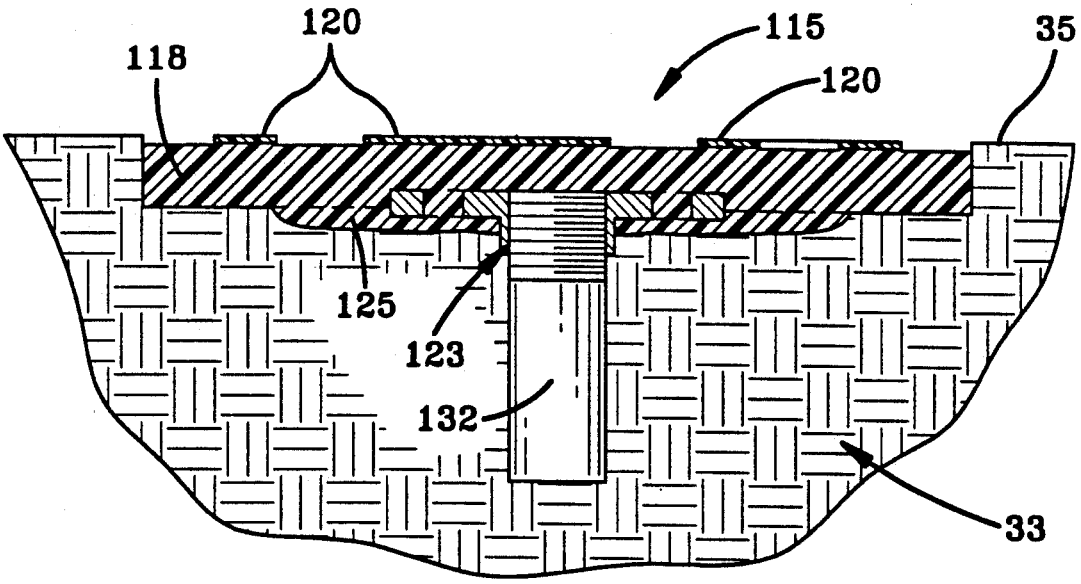
FIG. 9 is a view similar to FIG. 8 depicting the marker of FIG. 7 properly inverted and installed in the fairway of a golf course.
Figure 10:
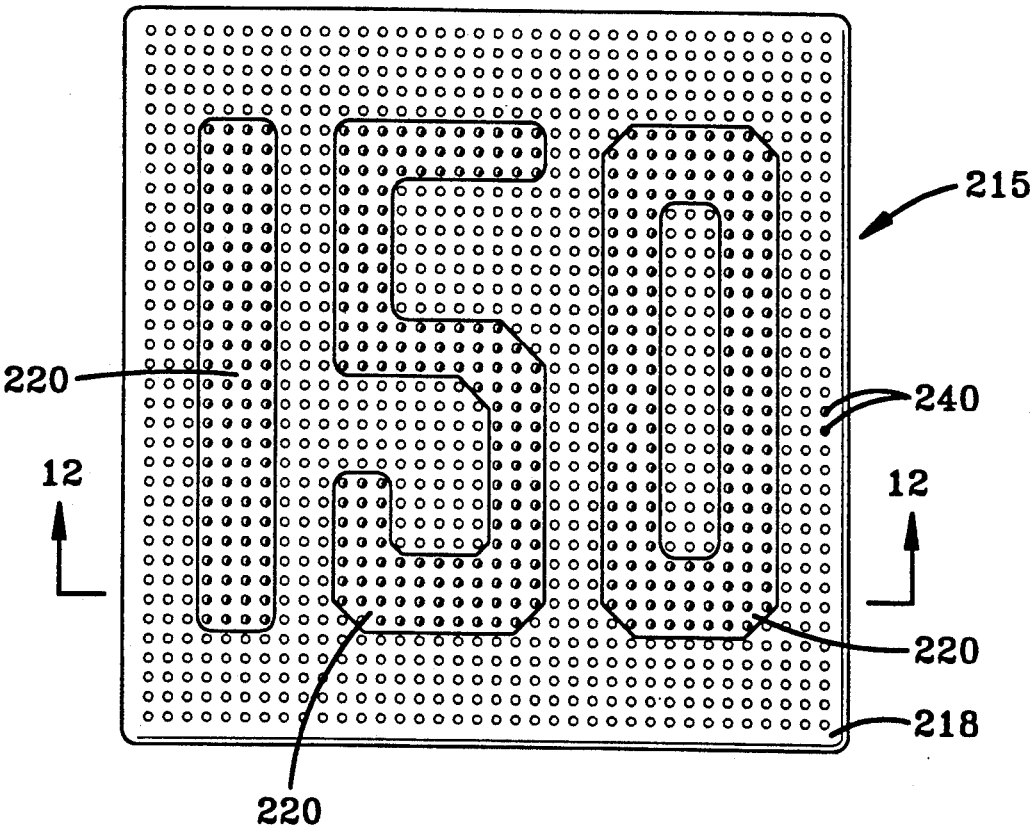
FIG. 10 a top view of a third embodiment of a marker embodying the present invention.
Figure 11:
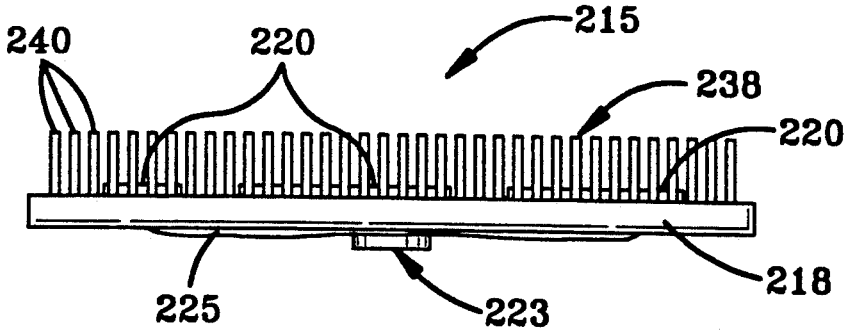
FIG. 11 a side view of the embodiment shown in FIG. 10.

A second embodiment of the yardage marker, identified by the number 115, is shown in FIGS. 7 through 9 wherein the indicia 120 is raised only a slight amount above the base 118. As such, the side walls 121 of each digit are not as high. The mold 122 which is utilized to form this embodiment of the yardage marker 115 is shown in FIG. 8. The indicia-forming cavities 128 are shallower than the indicia-forming cavities 28 of the embodiment shown in FIG. 5. In order to fill the indicia-forming cavities 128 so as not to permit the plastisol intended for those cavities to spill, or spread, into the base cavity one can exert extreme care when pouring the plastisol. Such care is not, however, necessarily feasible for production runs. In that situation the preferred manner of filling the indicia-forming cavities 128 is to introduce a pre-measured charge of the plastisol into each indicia-forming cavity 128, and at a rate that will permit the plastisol to spread only within the indicia-forming cavities and not, therefore, flow over into the base-forming cavity 129.

Another factor to be considered is that the material being introduced has a rather high viscosity. As such, one must take steps to assure that air will not be captured between the fusible plastic material and the surfaces of the mold into which the fusible material is being introduced. One method of "de-aerating" the mold is to place the mold in a vacuum chamber after the fusible material is introduced into the mold. Alternatively, it might be possible to cover at least those portions of the surface 136 on the base-forming cavity 129 of the mold 124 disposed adjacent the indicia-forming cavities 128 with a masking means, not shown, during the pouring of the plastisol into the indicia-forming cavities 128.

After the plastisol in the indicia-forming cavities 128 has gelled, the plastisol for the base 118 is then poured into the base-forming cavity 129 of the mold 122. As with the embodiment of FIG. 2, at an appropriate time the anchoring fitting 123 is positioned in the base-forming cavity 129 and prior to the time that the fusible material is poured into the base-forming cavity 129 of the mold 122. The mold, after it is filled, may be de-aerated prior to fusion.

The yardage markers 15 and 115, as shown in FIGS. 6 and 9, respectively, are shown with the base 118 being submerged below ground level such that the surface 35 of the ground 33 on which the grass of the main fairway 17 is growing will be at the same height as the top surface of the indicia presented from the yardage markers 15 or 115. In this way the yardage markers 15, or 115, do not inhibit mowing the grass on the fairway 11 inasmuch as the mowers will simply pass over the indicia 20, or 120, on the markers 15 or 115, respectively.

Another embodiment of the present invention in shown in the yardage marker 215 which is depicted in FIGS. 10 through 13. The yardage marker 215 has a base 218 and indicia 220, both of which combine to present an uppermost fibril-formed surface 238. The surface 238 is formed by a plurality of bristle-like, fibers 240 that extend upwardly from not only the numerical indicia 220 but also the base 218.

Figure 12:
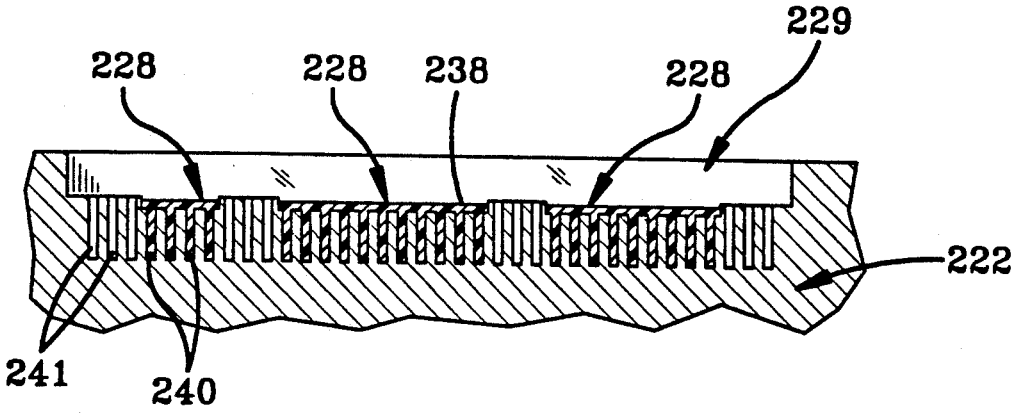
FIG. 12 a view showing a mold with the material forming the indicia and the related grass-like bristles having been introduced in such a way that the material did not flow into the remainder of the mold; and, FIG. 13 is a view similar to FIG. 12 showing the base and the grass-like bristles associated with the base having been poured into the mold.

As seen in FIG. 12, the mold 222 in which the yardage marker 215 is cast has a plurality of fibril-forming, trichoid sub-cavities 241 formed therein. The trichoid sub-cavities 241 extend from the shallow, indicia-forming cavities 228 as well as from the markedly deeper, base-forming cavity 229. It is desired that those fibers 240 which are formed in the sub-cavities 241 that communicate with the indicia-forming cavities 228 will have the same color as the numerical indicia 220. Likewise, it is preferred that the fibers 240 which are formed in the sub-cavities 241 that communicate with the base-forming cavities 229 will have the same color as the base 218.

One workable procedure by which to attain this desired color result involves the introduction of a predetermined amount of the plastisol into the shallow, indicia-forming cavities 228. With this embodiment, as well, the plastisol should be poured into the indicia-forming cavities 228 and then be de-aerated so that air will not be entrapped in the sub-cavities 241 extending outwardly from the indicia-forming cavities 228. By this approach the bristles 240 will be of the same color as the underlying indicia 220.

Figure 13:
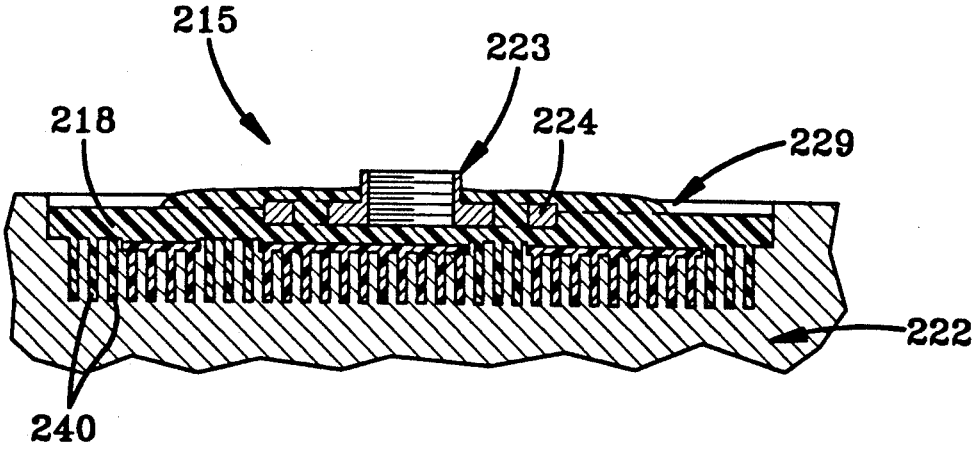

After the plastisol has gelled within the indicia-forming cavities 228, and the trichoid sub-cavities 241 associated therewith, the material forming the base 218, and the fibers 240 extending therefrom, can be poured. The completion of this step is depicted in FIG. 13. An anchor fitting 223 may be inserted into the cavity 229 at an appropriate time relative to the pouring of the fusible plastic material into the base-forming cavity 229. Although not depicted, the anchoring fitting 223 may be positioned by a fixture which assures that it is properly oriented within the mold. In any event, additional plastisol beyond that required to fill the base-forming cavity 229 may, if necessary or desired, be poured as an overlay 225 (FIG. 11) to cover the flange 224 of the anchoring fitting 223 and thereby ensure that the flange 224 on the anchoring fitting 223 will be as completely encapsulated within the base 218 of the marker 215 in order to secure the anchoring fitting 223 to the base 218.

Thereafter the mold 222 is placed in an oven, or is otherwise heated, to a temperature which will cause the two pours of plastisol within the mold 222 to fuse, as discussed in conjunction with the first described embodiment.

With the use of fibers 240, which present grass-like bristles to the golfer, it is possible to place markers virtually anywhere in the fairway 11. It should be understood that the other embodiments may also be so employed, but when the markers 15 are set in the center portion 17 of the fairway 11 they should not even give the impression of being capable of interfering with the golfer's lie. The use of yardage markers along the centerline of the fairway 11 is highly advantageous, and particularly in the dispositions depicted in FIG. 1, in that they can accurately designate intermediate yardages not usually seen on golf courses. Thus, the golfer has considerably more information available to assist in making the club selection during the game, and that information is immediately available without spending an undue amount of time simply looking for the markers themselves, as was most likely the situation when using prior known markers.

The embodiments depicted in the drawings may appear to suggest that each base 18, 118 or 218 needs to be substantially rectangular. However, no limitation on the shape of the markers 15, 115 or 215 is intended. Any shape which will accommodate the indicia 20, 120 or 220 can be used. For example, the base 18, 118 or 218 can be round, which will facilitate threading the markers onto their respective anchor rods until the top of the marker is flush with the surface of the turf, or ground, when utilizing the embodiments of FIGS. 2 and 7. When employing markers 215 embodying the embodiment depicted in FIG. 10, the surface 238 defined by the fibers 240 can be located at, or just beneath, the lowermost level to which the surrounding grass will be mowed. As such, the use of markers 15, 115 or 215 along the central portion 17 of the fairway 11, or the lateral side portions 16 thereof will not interfere with the mowing of the grass inasmuch as the markers can be readily established at heights substantially the same as, or slightly below, the surface of the grass after mowing.

The markers 15, 115 or 215 are preferably arranged in pairs when they are placed along the side portions 16 of the fairway 11. The golfers will appreciate that the distance is taken substantially halfway between these markers at the center of the fairway. This is the common method utilized when the markers are placed in the rough along the sides of the fairway 11.

As previously mentioned, the markers 15E may preferably have a white base and black numerals, because that is a commonly used coloration for the 150-yard distance. The markers 15F (located at 100 yards from the green) will usually have a red base and white numerals, while the markers 15D (located at 200 yards from the green) will usually have a blue base and white numerals, because the colors red and blue are currently being employed to designate 100 yards and 200 yards, respectively, by most golf courses in the United States. The remaining markers can have any color scheme desired. However, it is suggested that highly visible, but unobtrusive, colors be used.

The foregoing description of three exemplary embodiments of the invention have been presented for the purposes of illustration and description. The description is not intended to be exhaustive nor is to intended to limit the invention to the precise form disclosed. Obvious modifications or variations are possible in light of the above teachings. These embodiments were chosen and described to provide the best illustration of the principles of the invention and its practical application in order to enable one of ordinary skill in the art to utilize the invention in various embodiments and with various modifications that may be best suited for a particular use contemplated. All such modifications and variations are within the scope of the invention as determined by the appended claims when interpreted in accordance with the breadth to which they are fairly, legally and equitably entitled.

As should now be apparent, a marker embodying the concepts of the present invention, and manufactured according to the method thereof, not only provides an improved yardage designator for golf courses but also accomplishes the other objects of the invention.

I claim:

1. A yardage marker comprising:
a base having a first attribute;
a plurality of indicia having a second attribute distinguishable from the first attribute, each said indicia being integral to said base;
anchoring connector means for securing the marker in a desired position; and,
said anchoring connector means having a first portion integrally molded in said base and a second portion accessible from said base in a direction opposite from said indicia; and,
said indicia being numeric digits defined by side walls that extend upwardly from said base.

2. A marker, as set forth in claim 1, wherein:
said first attribute is one color; and
said second attitude is another color.

3. A marker, as set forth in claim 1, wherein said anchoring connector means further comprises:
said first portion including a flange portion secured within said base; and,
said second portion including a threaded portion extending outward from said base in a direction opposite the location of said indicia.

4. A marker, as set forth in claim 1, further comprising:
bristle means integrally formed with, and extending outwardly from, the indicia as well as from the base for providing a grass-like surface.

5. A molded marker comprising:
a base having a first color with upstanding bristle members formed integrally therewith;
a plurality of indicia having a second color and upstanding bristle members formed integrally therewith;
said second color being distinguishable from said first color;
each said indicia being integral with said base for presenting the indicia upward from said base;
said indicia having an upper edge spaced above said base; and,
anchoring means for securing the marker in a desired position.

* * * * *